US011566472B2

(12) United States Patent
Haugvaldstad et al.

(10) Patent No.: US 11,566,472 B2
(45) Date of Patent: Jan. 31, 2023

(54) DOWNHOLE TOOLS WITH TAPERED ACTUATORS HAVING REDUCED CYCLICAL TORQUE

(71) Applicant: Schlumberger Technology Corporation, Sugar Land, TX (US)

(72) Inventors: Kjell Haugvaldstad, Vanvikan (NO); Neil Cannon, Woodland Hills, UT (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 7 days.

(21) Appl. No.: 17/202,393

(22) Filed: Mar. 16, 2021

(65) Prior Publication Data

US 2021/0198949 A1 Jul. 1, 2021

Related U.S. Application Data

(63) Continuation of application No. 16/309,717, filed as application No. PCT/US2017/039358 on Jun. 27, 2017, now Pat. No. 10,968,703.

(60) Provisional application No. 62/357,215, filed on Jun. 30, 2016, provisional application No. 62/357,225, filed on Jun. 30, 2016.

(51) Int. Cl.
*E21B 7/06* (2006.01)
*E21B 17/10* (2006.01)

(52) U.S. Cl.
CPC ..... *E21B 7/068* (2013.01); *E21B 7/06* (2013.01); *E21B 17/1014* (2013.01); *E21B 17/1085* (2013.01)

(58) Field of Classification Search
CPC .... E21B 17/1014; E21B 17/1085; E21B 7/06; E21B 7/068; E21B 7/04
See application file for complete search history.

(56) References Cited

U.S. PATENT DOCUMENTS

| | | | | |
|---|---|---|---|---|
| 5,542,482 | A * | 8/1996 | Eddison | E21B 7/068 175/76 |
| 5,553,679 | A | 9/1996 | Thorp | |
| 5,673,763 | A | 10/1997 | Thorp | |
| 8,162,076 | B2 | 4/2012 | Martinez et al. | |
| 2008/0000693 | A1 | 1/2008 | Hutton | |
| 2008/0053707 | A1 | 3/2008 | Martinez et al. | |

(Continued)

FOREIGN PATENT DOCUMENTS

WO 2015086767 A1 6/2015

OTHER PUBLICATIONS

International Search Report and Written Opinion issued in International Patent Application No. PCT/US2017/039358, dated Sep. 26, 2017, 14 pages.

(Continued)

*Primary Examiner* — Caroline N Butcher

(57) ABSTRACT

A downhole tool includes a tool body and an actuator coupled to and selectively extendible relative to the tool body. The actuator has a working face that contacts a downhole formation, and which includes an upper portion and a lower portion. The lower portion has a tapered surface that is directed radially inwardly and axially downwardly relative to the first portion, with at least a portion of the tapered surface including an ultrahard material having a different coefficient of friction as compared to a first material of the upper portion.

20 Claims, 11 Drawing Sheets

(56) References Cited

U.S. PATENT DOCUMENTS

| | | | | |
|---|---|---|---|---|
| 2009/0044977 | A1 | 2/2009 | Johnson et al. | |
| 2010/0025116 | A1 | 2/2010 | Hutton | |
| 2010/0089583 | A1* | 4/2010 | Xu | E21B 10/32 175/57 |
| 2010/0282511 | A1 | 11/2010 | Maranuk et al. | |
| 2010/0319997 | A1 | 12/2010 | King et al. | |
| 2014/0083777 | A1 | 3/2014 | Korchounov | |
| 2015/0008045 | A1 | 1/2015 | Downton | |
| 2017/0122043 | A1 | 5/2017 | Shahipassand et al. | |
| 2019/0136632 | A1 | 5/2019 | Haugvaldstad et al. | |

OTHER PUBLICATIONS

International Preliminary Report on Patentability issued in International Patent Application No. PCT/US2017/039358, dated Jan. 1, 2019, 9 pages.

First Office Action and Search Report issued in Chinese Patent Application No. 201780037138.0, dated Mar. 18, 2020, 13 pages.

Second Office Action issued in Chinese Patent Application No. 201780037138.0, dated Nov. 3, 2020, 4 pages.

European Search and Examination Report under Rule 62 EPC issued in European Patent Application No. 17821037.3, dated Feb. 4, 2020, 8 pages.

Notice of Allowance and Fee(s) Due issued in U.S. Appl. No. 16/309,717, dated Dec. 8, 2020, 8 pages.

* cited by examiner

DOWNHOLE TOOLS WITH TAPERED ACTUATORS HAVING REDUCED CYCLICAL TORQUE

CROSS-REFERENCE TO RELATED APPLICATIONS

This application is a continuation of U.S. patent application Ser. No. 16/309,717 filed Dec. 13, 2018, which is a 371 national stage entry of International Patent Application No. PCT/US2017/039358, filed Jun. 27, 2017, which claims priority to and the benefit of U.S. Provisional Application No. 62/357,215, filed on Jun. 30, 2016, and to U.S. Provisional Application No. 62/357,225, filed on Jun. 30, 2016. The entireties of each of the foregoing applications are incorporated herein by this reference.

BACKGROUND

This section provides background information to facilitate a better understanding of the various aspects of the disclosure. It should be understood that the statements in this section of this document are to be read in this light, and not as admissions of prior art.

In underground drilling, a drill bit is used to drill a borehole into subterranean formations. The drill bit is attached to sections of pipe that stretch back to the surface. The attached sections of pipe are called the drill string. The section of the drill string that is located near the bottom of the borehole is called the bottom hole assembly (BHA). The BHA typically includes the drill bit, sensors, batteries, telemetry devices, and other equipment located near the drill bit. A drilling fluid, called mud, is pumped from the surface to the drill bit through the pipe that forms the drill string. The primary functions of the mud are to cool the drill bit and carry drill cuttings away from the bottom of the borehole and up through the annulus between the drill pipe and the borehole.

Because of the high cost of setting up drilling rigs and equipment, it is desirable to be able to explore formations other than those located directly below the drilling rig, without having to move the rig or set up another rig. In off-shore drilling applications, the expense of drilling platforms makes directional drilling even more desirable. Directional drilling refers to the intentional deviation of a wellbore from a vertical path. A driller can drill to an underground target by pointing the drill bit in a desired drilling direction.

SUMMARY

In some embodiments of a push-the-bit steering device, a steering body may include a series of actuators installed radially around the body, each actuator mounted transverse to the axis of the body. On each actuator is a working face, which may contain one surface, or more than three surfaces. A first surface of the working face may be approximately parallel to the axis of the body. A second surface, downhole of the working face, may slant radially inward from the first surface. A third surface, uphole of the working face, may slant radially inward from the first surface.

The working face may include two materials: a first material including a standard wear material and a second surface including an ultrahard insert. The ultrahard insert may have a different coefficient of friction from the first material. The ultrahard insert may be located primarily on the leading and downhole edges of the working face. In some embodiments, the ultrahard insert may include 25% of the perimeter and 25% of area of the working face.

In some embodiments, the actuator may include a radially inward shaft and a radially outward body. The shaft and the body of the actuator may have different cross-sectional areas. In the embodiment where the shaft has a larger cross-sectional area than the body, a stop may be placed on the receiver of the actuator to prevent ejection of the actuator from the steering body. Additionally, the shaft and body may have non-round profiles, including elliptical, square, hexagonal, polygonal of any number of sides, concave polygonal, any non-polygonal enclosed shape, or any other enclosed shape. When used in combination with a complimentarily shaped receiver, the non-round shaft or body may prevent rotation through contact with the receiver. The receiver may include a tungsten carbide band, sized with a clearance over the actuator such that in combination with a hydraulic fluid of sufficient viscosity, a sealing surface is created. Standard elastomeric seals are not durable enough to withstand the harsh, high-repetition environment to which the pistons are exposed; a tungsten carbide band may withstand the conditions.

In other embodiments, the actuator may have a cradle on the radially outward face. The cradle may house a roller, configured to contact the borehole wall. Upon actuation, the roller may contact the borehole wall, and roller may roll along the surface of the borehole wall

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which:

FIGS. 4-1 through 4-3 are cross-sectional views of embodiments of actuator assemblies in a directional drilling system showing assemblies of two, three and four actuators, according to the present disclosure;

FIGS. 6-1 and 6-2 are schematic views of an embodiment of an actuator using a guide pin and channel to direct actuation, according to the present disclosure;

FIGS. 8-1 through 8-2 illustrate further embodiments of the working face of FIG. 7, according to the present disclosure;

FIGS. 9-1 through 9-5 illustrate embodiments of actuators having various cross-sectional areas, according to the present disclosure;

FIGS. 10-1 and 10-2 illustrate embodiments of actuators with examples of differing shaft and body sizes, according to the present disclosure;

FIGS. 11-1 and 11-2 illustrate embodiments of a band in a receiver in combination with a hydraulic fluid to create a sealing surface with the actuator, according to the present disclosure;

FIGS. 12-1 and 12-2 are cross-sectional views of the embodiments of the band of FIGS. 11-1 and 11-2, showing clearance between the band and the actuator, according to the present disclosure; and FIGS. 13-1 and 13-2 illustrate an embodiment of an actuator with a roller in a cradle, according to the present disclosure.

DETAILED DESCRIPTION

Figure 1:
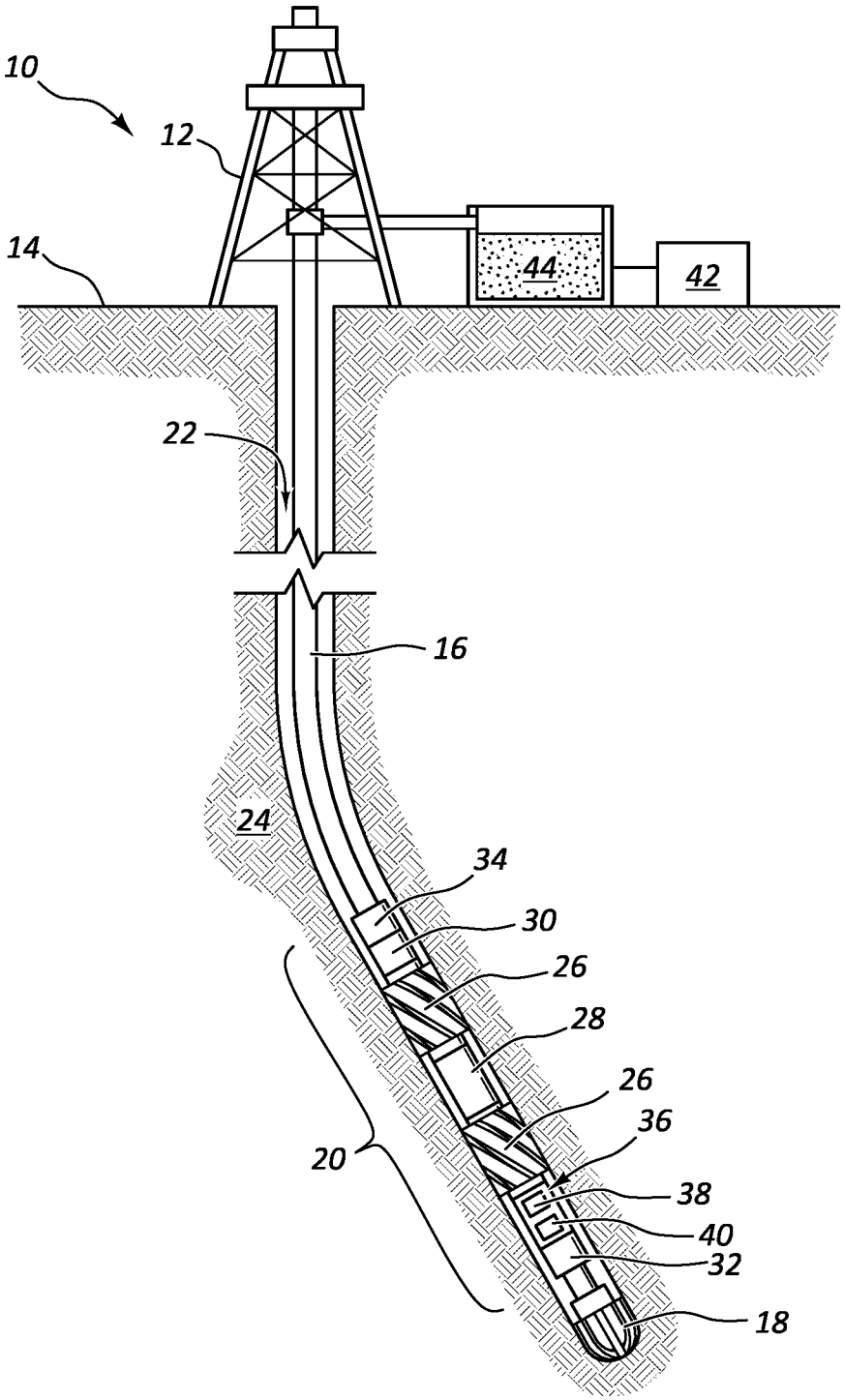
FIG. 1 is a schematic diagram of an embodiment of a directional drilling system with a directional drilling actuator assembly, according to the present disclosure.

It is to be understood that the following disclosure provides many different embodiments, or examples, for implementing different features of various embodiments. Specific examples of components and arrangements are described below to simplify the disclosure. These are, of course, merely examples and are not intended to be limiting. In addition, the disclosure may repeat reference numerals and/or letters in the various examples. This repetition is for the purpose of simplicity and clarity and does not in itself dictate a relationship between the various embodiments and/or configurations discussed.

As used herein, the terms connect, connection, connected, in connection with, and connecting may be used to mean in direct connection with or in connection with via one or more elements. Similarly, the terms couple, coupling, coupled, coupled together, and coupled with may be used to mean directly coupled together or coupled together via one or more elements. Terms such as up, down, top and bottom and other like terms indicating relative positions to a given point or element may be utilized to more clearly describe some elements. Commonly, these terms relate to a reference point such as the surface from which drilling operations are initiated.

The directional drilling process creates geometric boreholes by steering a drilling tool along a planned path. A directional drilling system typically utilizes a steering assembly to steer the drill bit and to create the borehole along the desired path (i.e., trajectory). Steering assemblies may be classified generally, for example, as a push-the-bit or point-the-bit devices. Push-the-bit devices typically apply a side force on the formation to influence the change in orientation. A point-the-bit device typically has a fixed bend in the geometry of the bottom hole assembly. Rotary steerable systems ("RSS") provide the ability to change the direction of the propagation of the drill string and borehole while drilling.

According to one or more embodiments, control systems may be incorporated into the downhole system to stabilize the orientation of propagation of the borehole and to interface directly with the downhole sensors and/or actuators. For example, directional drilling devices (e.g., RSS and non-RSS devices) may be incorporated into the bottom hole assembly. Directional drilling may be positioned directly behind the drill bit in the drill string. According to one or more embodiments, directional drilling devices may include a control unit and bias unit. The control unit may include, for example, sensors in the form of accelerometers and/or magnetometers to determine the orientation of the tool and the propagating borehole, and processing and memory devices. The accelerometers and magnetometers may be referred to generally as measurement-while-drilling sensors. The bias unit may be referred to as the main actuation portion of the directional drilling tool and the bias unit may be categorized as a push-the-bit or point-the-bit actuators. The drilling tool may include a power generation device, for example, a turbine to convert the downhole flow of drilling fluid into electrical power.

Push-the-bit steering devices apply a side force to the formation through a stabilizer for example. This provides a lateral bias on the drill bit through bending in the borehole. Push-the-bit steering devices may include, for example, actuator pads. According to some embodiments, a motor in the control unit rotates a rotary valve that directs a portion of the flow of drilling fluid into actuator chambers. The differential pressure between the pressurized actuator chambers and the formation applies a force across the area of the pad to the formation. A rotary valve, for example, may direct the fluid flow into an actuator chamber to operate a pad and create the desired side force. In these systems, the tool may be continuously steering.

In point-the-bit steering devices, the axis of the drill bit is at an angular offset to the axis of the bottom hole assembly. For example, the outer housing and the drill bit may be rotated from the surface and a motor may rotate in the opposite direction from the outer housing. A power generating device (e.g., turbine) may be disposed in the drilling fluid flow to generate electrical power to drive a motor. The control unit may be located behind the motor, with sensors that measure the attitude and control the tool face angle of the fixed bend.

FIG. 1 is a schematic illustration of an embodiment of a directional drilling system 10 in which embodiments of steering devices and steering actuators may be incorporated. The directional drilling system 10 includes a rig 12 located above a surface 14 and a drill string 16 suspended from the rig 12. A drill bit 18 disposed with a bottom hole assembly ("BHA") 20 and deployed on the drill string 16 to drill (i.e., propagate) a borehole 22 into a formation 24.

The depicted BHA 20 includes one or more stabilizers 26, a measurement-while-drilling ("MWD") module or sub 28, a logging-while-drilling ("LWD") module or sub 30, a steering system 32 (e.g., RSS device, steering actuator, actuators, pads), a power generation module or sub 34, or combinations thereof. The directional drilling system 10 includes an attitude hold controller 36 disposed with the BHA 20 and operationally connected with the steering system 32 to maintain the drill bit 18 and the BHA 20 on a desired drill attitude to propagate the borehole 22 along the desired path (i.e., target attitude). The depicted attitude hold controller 36 includes a downhole processor 38 and direction and inclination ("D&I") sensors 40, for example, accelerometers and magnetometers. According to an embodiment, the downhole attitude hold controller 36 is a closed-loop system that interfaces directly with the BHA 20 sensors (e.g., the D&I sensors 40, the MWD sub 28 sensors, and the steering system 32 to control the drill attitude). The attitude hold controller 36 may be, for example, a unit configured as a roll stabilized or a strap down control unit. Although embodiments are described primarily with reference to rotary steerable systems, it is recognized that embodiments may be utilized with non-RSS directional drilling tools. The directional drilling system 10 includes drilling fluid or mud 44 that can be circulated from the surface 14 through the axial bore of the drill string 16 and returned to the surface 14 through the annulus between the drill string 16 and the formation 24.

Figure 2:
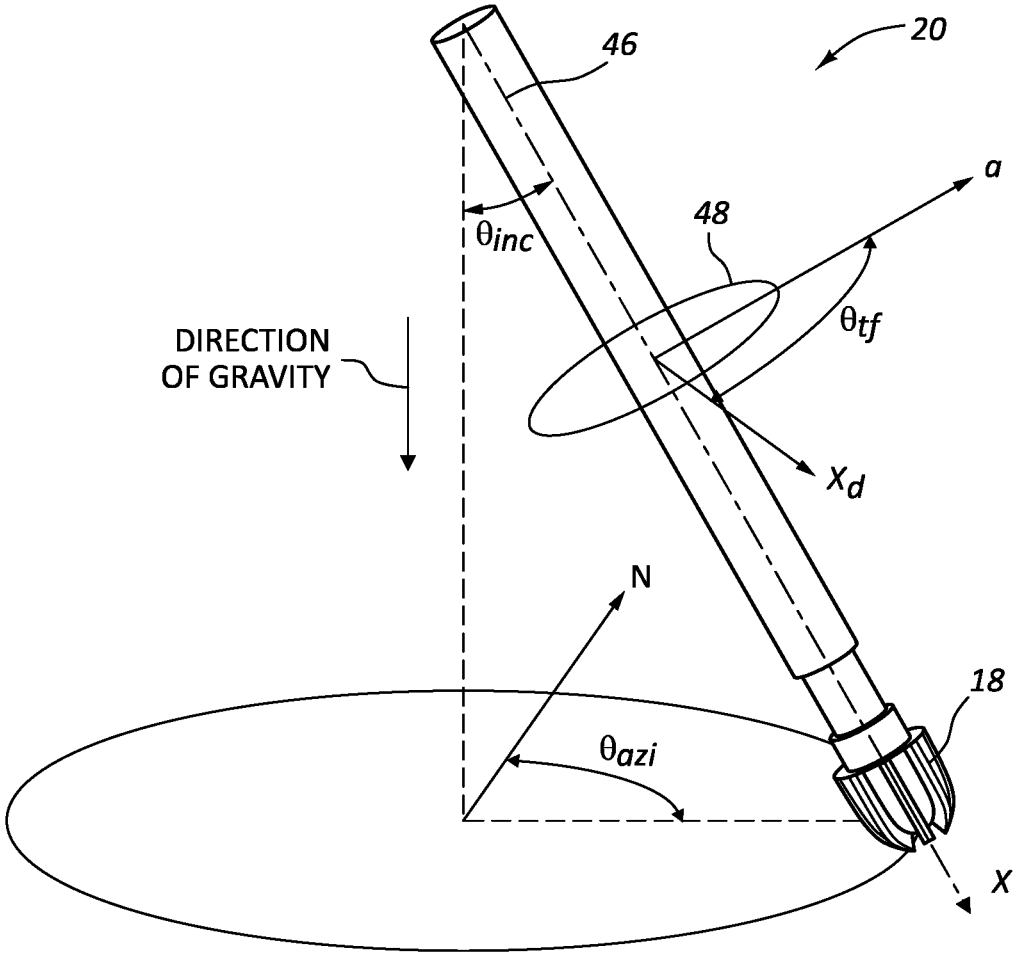
FIG. 2 is a pictorial diagram of attitude and steering parameters depicted in a global coordinate reference frame, according to the present disclosure.

The tool's attitude (e.g., drill attitude) is generally identified as the rotational axis 46 of the BHA 20 for example in FIG. 2. Attitude commands may be inputted (i.e., transmitted) from a directional driller or trajectory controller generally identified as a surface controller 42 (e.g., processor) in the illustrated embodiment. Signals, such as the demand attitude commands, may be transmitted for example via mud pulse telemetry, wired pipe, acoustic telemetry, and wireless transmissions. Accordingly, upon directional inputs from the surface controller 42, the downhole attitude hold controller 36 controls the propagation of the borehole 22 through a downhole closed loop, for example by operating the steering system 32. In particular, the steering system 32 is actuated to drive the drill to a set point.

In the point-the-bit system, the axis of rotation of the drill bit 18 is deviated from the local rotational axis 46 (e.g., FIG. 2) of the BHA 20 in the general direction of the new borehole 22. The borehole 22 is propagated in accordance with the customary three-point geometry defined by upper and lower stabilizer 26 contact points and the drill bit 18 contact point with the formation 24. The angle of deviation of the drill bit axis coupled with a finite distance between the drill bit and lower stabilizer results in the non-collinear condition required for a curve to be generated. There are many ways in which this may be achieved including a fixed bend at a point in the bottom hole assembly close to the lower stabilizer or a flexure of the drill bit drive shaft distributed between the upper and lower stabilizer.

In the push-the-bit rotary steerable system there is usually no specially identified mechanism to deviate the drill bit axis from the local bottom hole assembly axis; instead, the requisite non-collinear condition is achieved by causing either or both of the upper or lower stabilizers to apply an eccentric force or displacement in a direction that is preferentially orientated with respect to the direction of the borehole propagation. There are many ways in which this may be achieved, including non-rotating (with respect to the hole) eccentric stabilizers (displacement based approaches) and eccentric actuators that apply force to the drill bit in the desired steering direction. As noted above, steering is achieved by creating non co-linearity between the drill bit and at least two other touch points.

FIG. 2 illustrates attitude and steering parameters for a bottom hole assembly 20, identified by a rotational axis 46, in a global or Earth reference frame coordinate system. The Earth reference frame is the inertial frame which is fixed and corresponds to the geology in which the borehole is being drilled and by convention is a right handed coordinate system with the x-axis pointing downhole and the y-axis pointing magnetically North. The attitude is the direction of propagation of the drill bit and represented by a unit vector for the downhole control systems. The instantaneous attitude "X" of the BHA 20 is indicated by the inclination $\theta_{inc}$ and azimuth $\theta_{azi}$ angles. The data from the BHA 20 (e.g., the D&I sensors 40) may be communicated to the surface controller 42 (e.g., the direction driller) for example via a low bandwidth (2 to 20 bits per second) mud pulse to identify the instantaneous inclination and azimuth and thus the attitude of the BHA 20. The tool face is identified by the numeral 48 and the tool face angle, $\theta_{tf}$, is the clockwise difference in angle between the projection of "a" in the tool face plane and the steering direction (i.e., target or demand attitude) "$x_d$" in the plane. The directional driller (e.g., the surface controller 42) communicates attitude reference signals to the downhole attitude hold controller 36 (e.g., the processor 38). The reference signals for example being a demand tool inclination and demand tool azimuth set points for the desired tool orientation in the Earth reference frame. For example, the steering system 32 (e.g., the tool face actuator) is operated to direct the drill bit along the desired attitude.

Figure 3:
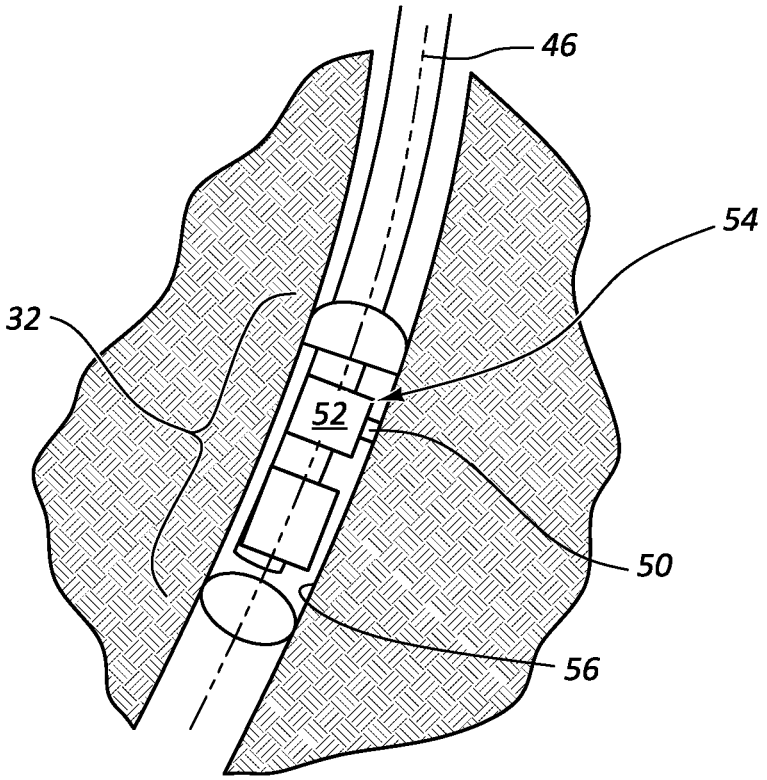
FIG. 3 is a schematic representation of an actuator assembly in a downhole environment, according to the present disclosure.
Figures 1, 4:
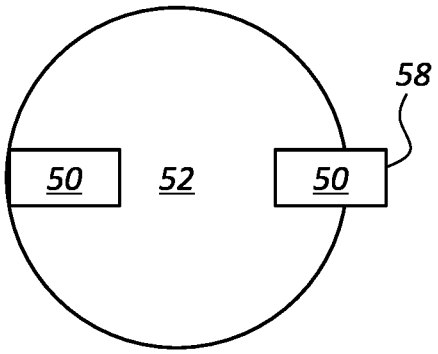
Figures 2, 4:
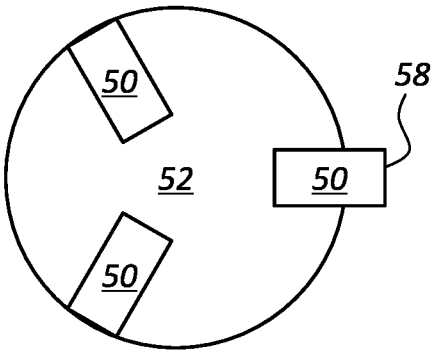
Figures 3, 4:
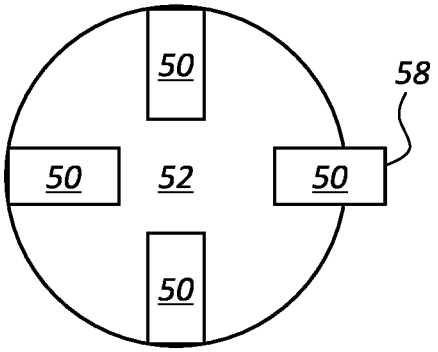

FIG. 3 illustrates the actuator assembly 54 of steering system 32 according to one or more embodiments. The steering system 32 (e.g., bias unit) includes a plurality of steering actuators 50 (e.g., actuators, pads) arranged radially in the bias body 52 and transverse to the rotational axis 46 of the bias body 52. FIGS. 4-1 through 4-3 show examples of actuator 50 placements in a cross-sectional view of the bias body 52. For example, FIG. 4-1 illustrates actuators 50 positioned radially opposing one another at 180° intervals. FIG. 4-2 illustrates actuators 50 positioned at 120° intervals around the bias body 52. FIG. 4-3 illustrates actuators 50 positioned at 90° intervals about the bias body 52. Note that in various embodiments, two, three, four or more actuators may be distributed evenly around the bias body 52. In other embodiments, the actuators 50 may be distributed about the bias body 52 at uneven intervals. At least one actuator may be actuated, independently of the remaining actuators, to extend radially out of the bias body 52 toward the borehole wall 56.

In a push-the-bit rotary steerable system, upon extension, the actuator 50 may contact the borehole wall 56, applying a force. A correspondingly opposite force will be applied to the bias body 52. The force transfers from the bias body 52, located in the steering system 32, down through the BHA 20 and to the drill bit 18, pushing the bit in approximately the opposite direction of the force.

Figure 5:
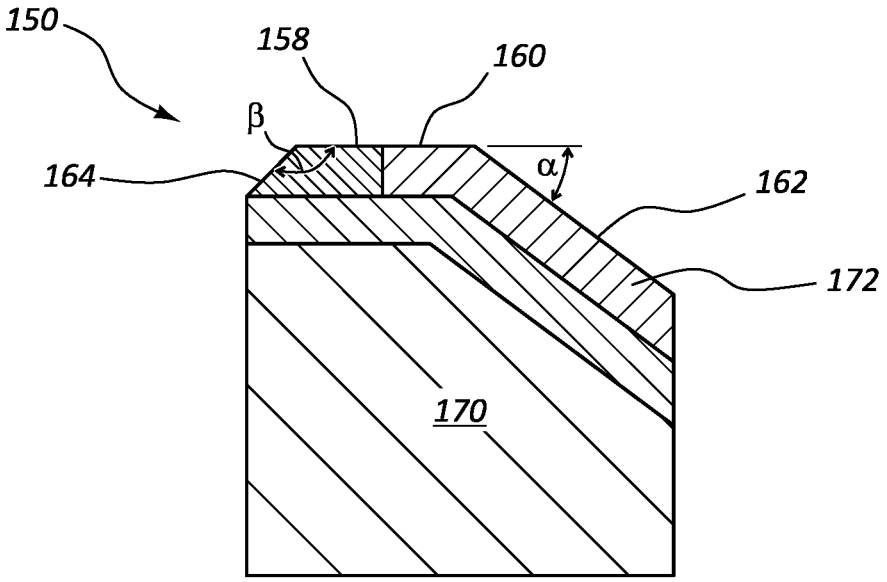
FIG. 5 is a cross-sectional view of an embodiment of a multi-surfaced actuator, according to the present disclosure.

FIG. 5 details a longitudinal cross-sectional view of an actuator 150. The working face 158 may include up to three surfaces: a first surface 160, a second surface 162 and a third surface 164. In some embodiments, the first surface 160 has a profile in the longitudinal direction that is approximately parallel to the local axis. For example, when the tool is oriented in a downhole environment, the first surface 160 may be parallel to the axis of the tool and/or parallel to a surface of the wellbore. Downhole of the first surface 160 may be the second surface 162, which may slant radially inward from the first surface 160 at an angle $\alpha$ (alpha). Uphole of first surface 160 may be the third surface 164, which may slant radially inward from the first surface 160 at an angle $\beta$ (beta) away from the second surface 162. Each of the first, second and third surfaces may be curved parallel to the local axis to approximately the same radius as the borehole wall. In some embodiments, the first surface 160 may account for approximately 50% of the working face 158. In other embodiments, the first surface 160 may account for more than 50% or less than 50% of the working face 158. In some embodiments, the first surface 160 may include more than 25% of the perimeter of the working face 158.

Figures 1, 6:
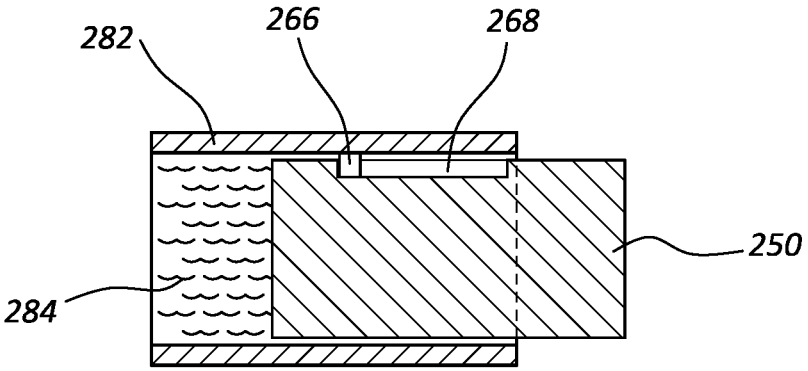
Figures 2, 6:
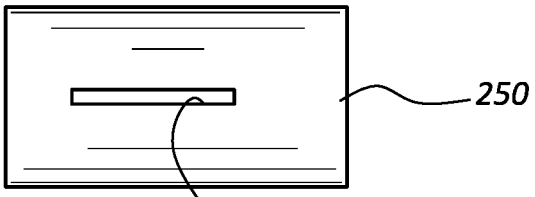

FIGS. 6-1 and 6-2 illustrate movement of an actuator 250 relative to a receiver 282. A hydraulic fluid 284 may apply a force to the actuator 250 to move the actuator 250 relative to a receiver 282. FIGS. 6-1 shows that during actuator extension, the guide pin 266 slides through the pin channel 268 until it hits the radially inside end of the pin channel 268, at which point the guide pin 266 contacts the edge of the pin channel 268, thereby stopping further extension. During actuator retraction, the guide pin 266 slides through the pin channel 268 until it hits the radially outside end of the pin channel 268, thereby stopping further retraction.

Additionally, the guide pin 266 may prevent rotation of the actuator 250 by contact with the walls of the pin channel 268 upon introduction of a torque to the actuator 250. The pin channel 268 need not be straight; the pin channel 268 may include a 90° turn at the radially inside end. Then after a distance, the pin channel 268 may include an additional 90° turn back toward the end of the actuator 250.

Figure 7:
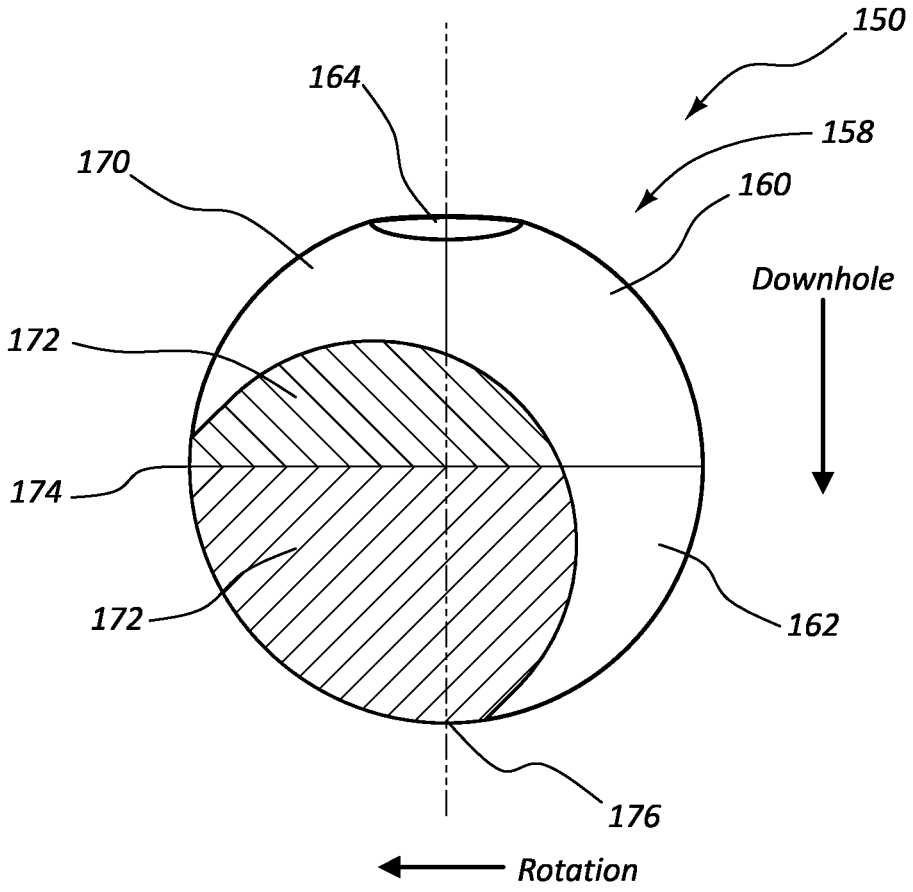
FIG. 7 is a representation of the working face of the embodiment of an actuator of FIG. 5, showing multiple surfaces and materials, according to the present disclosure.

Referring back to FIG. 5, upon contact with the borehole wall, the first surface 160 and second surface 162 may experience different frictional forces with the borehole wall. The different forces between the first surface 160 and the second surface 162 of the working face 158 may induce a cyclic clockwise (CW)/counter-clockwise (CCW) torque on the actuator 150. Referring again to FIG. 6-1, the cyclic CW/CCW torque places stress on the guide pin 266. Referring now to FIG. 7, a decrease of the percentage of the surface area of the working face 158 of the first surface 160 from 50% to less than 50% may provide a more unidirectional torque when the working face 158 contacts the borehole wall. Reducing the stress on the guide pin may save both material and operating costs.

In some embodiments of the present disclosure, the working face 158 of the actuator 150 may include two or more materials. At least one of the materials may include an ultrahard material. As used herein, the term "ultrahard" is understood to refer to those materials known in the art to have a grain hardness of about 1,500 HV (Vickers hardness in kg/mm$^2$) or greater. Such ultrahard materials can include those capable of demonstrating physical stability at temperatures above about 750° C., and for certain applications above about 1,000° C., that are formed from consolidated materials. Such ultrahard materials can include but are not limited to diamond, polycrystalline diamond (PCD), leached PCD, non-metal catalyst PCD, hexagonal diamond (Lonsdaleite), cubic boron nitride (cBN), polycrystalline cBN (PcBN), binderless PCD, nanopolycrystalline diamond (NPD), Q-carbon, binderless PcBN, diamond-like carbon, boron suboxide, aluminum manganese boride, metal borides, boron carbon nitride, or other materials in the boron-nitrogen-carbon-oxygen system which have shown hardness values above 1,500 HV, as well as combinations of the above materials. In some embodiments, the ultrahard material may have a hardness value above 3,000 HV. In other embodiments, the ultrahard material may have a hardness value above 4000 HV. In yet other embodiments, the ultrahard material may have a hardness value greater than 80 HRa (Rockwell hardness A).

Each ultrahard material has a specific coefficient of friction on contact with and movement along another material. When the ultrahard materials are placed on the working face 158 and put in contact with a borehole wall, the frictional forces can have an impact on borehole drilling. For example, a reduced coefficient of friction may reduce rotational resistance of the actuator assembly. Additionally, a reduced coefficient of friction may reduce actuator wear on the working face 158 and/or other portions of the actuator 150. A reduced coefficient of friction may also reduce gouging of the borehole wall. Each of these may result in reduced material costs for actuator replacement, reduced operational costs from tripping the actuator assembly to the surface, and improved borehole walls.

FIG. 7 provides an end-view of the working face 158 of FIG. 5. For example, the first material 170 may include thermally stable polycrystalline diamond (TSP) inserts on a tungsten carbide bed (e.g., infiltrated tungsten carbide), and the second material 172 may include a PCD insert. In some embodiments, PCD may have a lower coefficient of friction than diamond inserts on a tungsten carbide bed, with a ratio of coefficients of friction between TSP inserts on a tungsten carbide bed and PCD of about 4.0:1. The PCD may be sintered in a high-pressure high-temperature (HPHT) press using a tungsten carbide substrate. The tungsten carbide substrate may then be connected to the actuator using braze, epoxy, a mechanical connection such as a dovetail joint or a threaded connection, or some other secure connection. In some embodiments, the working face 158 may include a total surface area of more than two square inches, and the second material 172 may include a total surface area of more than one square inch (e.g., the ultrahard material may cover greater than 50% of the surface area of the working face). In some embodiments, the ultrahard material may cover between 30 and 90% of the surface area of the working face, and in still other embodiments, the ultrahard material may cover between 40 and 80% of the surface of the working face. However, the ultrahard material may cover any suitable percentage of the working face.

Placement of the second material 172 on the working face 158 in combination with a different first material 170 may result in differential frictional forces acting on the working face 158. The differential frictional forces on the working face 158 will produce a torque applied to the actuator 150. This frictional torque may combine with the cyclic CW/CCW torque to produce a net torque on the actuator 150. Changing the second material 172 to a material with a different coefficient of friction may result in a different net torque. In this manner, an actuator 150 may be developed for drilling conditions from combinations of the first material 170 and the second material 172. For example, the materials and/or relative sizes of the first and second materials may be modified to achieve a desired net torque. In at least one embodiment, the frictional torque will completely counteract one of the opposing cyclic CW/CCW torques, resulting in a unidirectional torque on actuator 150.

The working face 158 includes a leading edge 174 and a downhole edge 176. The leading edge 174 is the edge of the working face 158 that is first to come into contact with the borehole wall 56 as the steering system 32 rotates. The leading edge 174 may include up to half of the perimeter of the working face 158. The downhole edge 176 is the edge of the working face 158 that is first to come into contact with the borehole wall 56 as the steering system 32 travels downhole. The downhole edge 176 may include up to half of the perimeter of the working face 158. The second material 172 may be located on at least a portion of the leading edge 174 or the downhole edge 176. In some embodiments, the second material 172 includes at least 25% of the perimeter of the working face 158 and 25% of the surface area of the working face 158, primarily located in the quadrant of the working face 158 that includes both the leading edge 174 and the downhole edge 176. In some embodiments, the second material covers between 20 and 60% of the perimeter of the working face, and in some embodiments, the second material covers between 25 and 40% of the perimeter of the working face.

In some embodiments, the second material 172 is different from the first material 170, and the first material 170 and the second material 172 have a different coefficient of friction. As discussed above, materials with differing coefficients of friction on the working face 158 may result in a net torque on the actuator 150. Altering the location and extent of the second material 172 may result in a different net torque. In this manner, an actuator may be developed for drilling conditions from using different first and/or second materials. In some embodiments, the ratio of coefficients of friction between the first material and the second material may include a range of ratios, the range having an upper value, a lower value, or upper and lower values including 1:1, 2:1, 3:1, 4:1, 5:1, 6:1, 7:1, 8:1, 9:1, 10:1, or any value therebetween. For example, the ratio of coefficients of friction may be 1:1, meaning the coefficients of friction are the same. In other examples, the ratio of coefficients of friction may be 10:1. In yet other examples, the ratio of coefficients of friction may be a range of 1:1 to 10:1.

In the embodiment shown in FIGS. 5 and 7, the second material 172 is PCD, sintered on a tungsten carbide substrate. The first material 170 may be thermally stable polycrystalline diamond (TSP) inserts set in infiltrated tungsten carbide. In one embodiment the second material 172 may be located on more than one surface, either the first surface 160 and the second surface 162, the first surface 160 and the third surface 164, or the first surface 160 the second surface 162 and the third surface 164. The second material 172 may also be located only on one surface, either the first surface 160, second surface 162, or third surface 164. In other embodiments, the second material 172 may include more than 60% of the second surface 162. In still other embodiments, the second material 172 may be positioned across a portion of the second surface 162 in a range having an upper value, a lower value, or upper and lower values including any of 0%, 10%, 20%, 30%, 40%, 50%, 60%, 70%, 80%, 90%, 100%, or any value therebetween. For example, the second material 172 may be greater than 0% of the second surface 162. In other examples, the second material 172 may be less than 100% of the second surface 162. In yet other examples, the second material 172 may be in a range of 0% to 100% of the second surface 162.

Figures 1, 8:
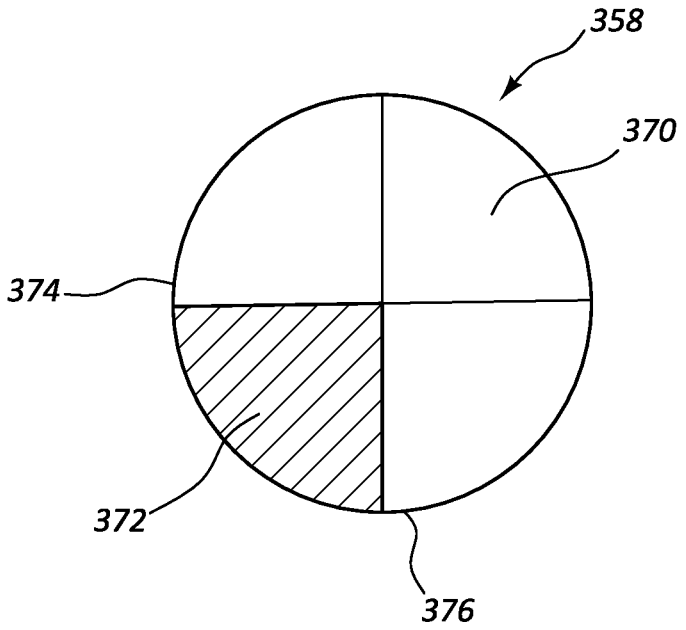
Figures 2, 8:
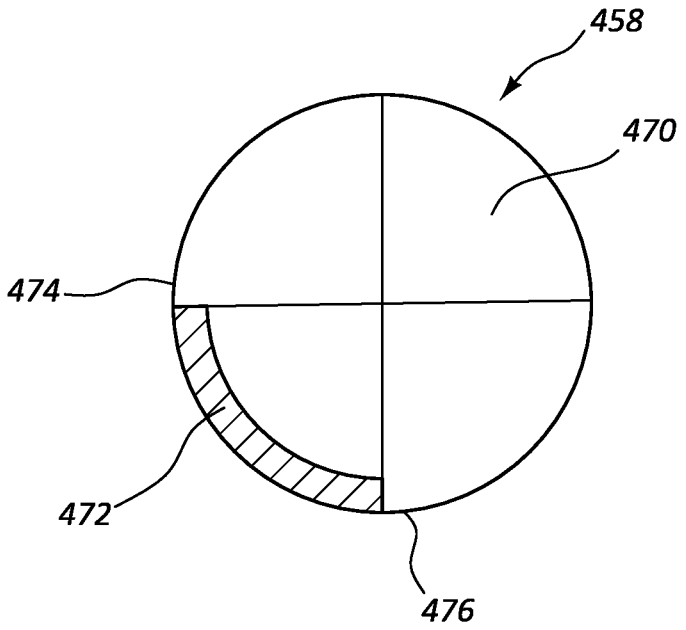

FIGS. 8-1 and 8-2 show other embodiments of the configuration between the first material 170 and second material 172 of FIG. 7. In the embodiment of FIG. 8-1, the second material 372 comprises approximately 25% of the area and perimeter of the working face 358 from the center of the leading edge 374 down to the center of the downhole edge 376. The first material 370 accounts for the remainder of the area and the perimeter of the working face 358. In other embodiments, the second material 372 may be positioned across a portion of the working face 358 in a range having an upper value, a lower value, or upper and lower values including any of 10%, 20%, 30%, 40%, 50%, 60%, 70%, or any value therebetween. For example, the second material 372 may be greater than 10% of the working face 358. In other examples, the second material 372 may be less than 70% of the working face 358. In yet other examples, the second material 372 may be in a range of 10% to 70% of the working face 358.

In the embodiment of FIG. 8-2, the second material 472 comprises a strip located on the perimeter of the working face 458 from the leading edge 474 down to the downhole edge 476. In other embodiments, the second material 472 may be positioned across a portion of the perimeter of the working face 458 in a range having an upper value, a lower value, or upper and lower values including any of 10%, 20%, 30%, 40%, 50%, 60%, 70%, or any value therebetween. For example, the second material 472 may be positioned on greater than 10% of the working face 458 perimeter. In other examples, the second material 472 may be positioned on less than 70% of the working face 458 perimeter. In yet other examples, the second material 472 may be positioned on in a range of 10% to 70% of the working face 458 perimeter.

Additional embodiments of working faces 458 could include the second material 472 covering the entire leading edge 474 hemisphere of the working face 458. Still other embodiments could include the second material 472 including the entire downhole edge 476 hemisphere of the working face 458. In still other embodiments, the entire working face 458 could be covered with the second material 472. FIGS. 8-1 and 8-2 are solely representations of possible configurations; any combination or geometry of the first material 470 and the second material 472 is envisioned by this application.

Figures 1, 9:
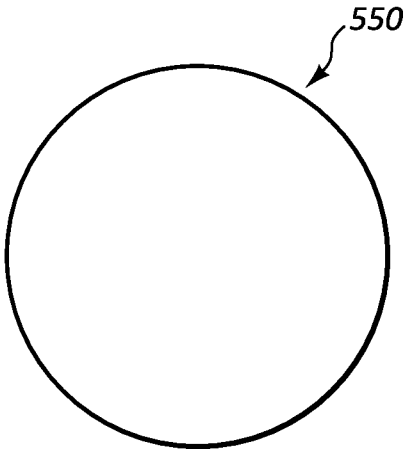
Figures 2, 9:
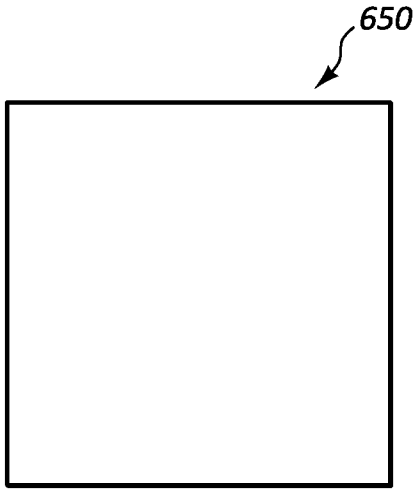
Figures 3, 9:
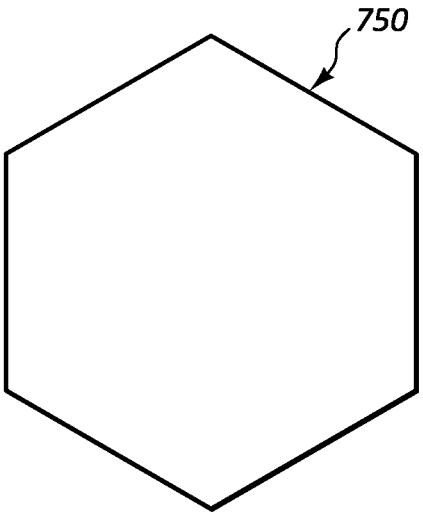
Figures 4, 9:
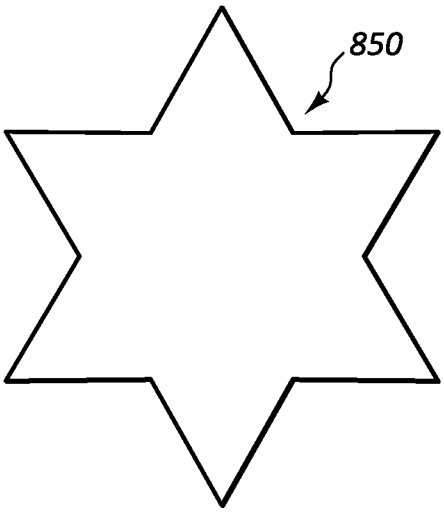
Figures 5, 9:
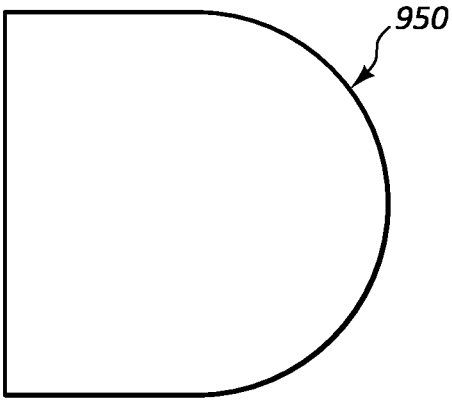

FIGS. 9-1 through 9-5 refer to a series of further embodiments of the actuator, where the shape of at least part of the actuator may be non-round. When a portion of a non-round actuator is inserted into a complementarily shaped receiver, the portion of the non-round actuator will contact the receiver when acted on by a torque, thereby preventing free rotation. With no free rotation, the guide pin 266 and channel 268 of FIG. 6 may no longer be needed to prevent rotation. At least a portion of an embodiment of an actuator may have a non-circular transverse cross-sectional shape. For example, the transverse cross-sectional shape may be one of a variety of shapes. For example, an embodiment of an actuator 550 may have a transverse cross-sectional shape that is an ellipsoid (FIG. 9-1), a square actuator 650 (FIG. 9-2), a hexagonal actuator 750 (FIG. 9-3), a polygonal actuator of any number of sides (FIGS. 9-2 through 9-4), a concave polygon actuator 850 (FIG. 9-4), or a non-polygonal enclosed shaped actuator 950 (FIG. 9-5). For example, the elliptical actuator 550 of FIG. 9-1 need only have a sufficient difference in magnitude between the major axis and the minor axis so as to prevent binding upon extension or retraction of the actuator. In some embodiments, the major axis of the elliptical actuator 550 may be larger than the minor axis in a range having an upper value, a lower value, or upper and lower values including any of 10%, 20%, 30%, 40%, 50%, 60%, 70%, 80%, 90%, 100%, or any value therebetween. For example, the elliptical actuator 550 may have a major axis greater than 10% larger than the minor axis. In other embodiments, the major axis may be less then 100% larger than the minor axis. In yet other examples, the major axis may be in a range of 10% to 100% larger than the minor axis.

Figures 1, 10:
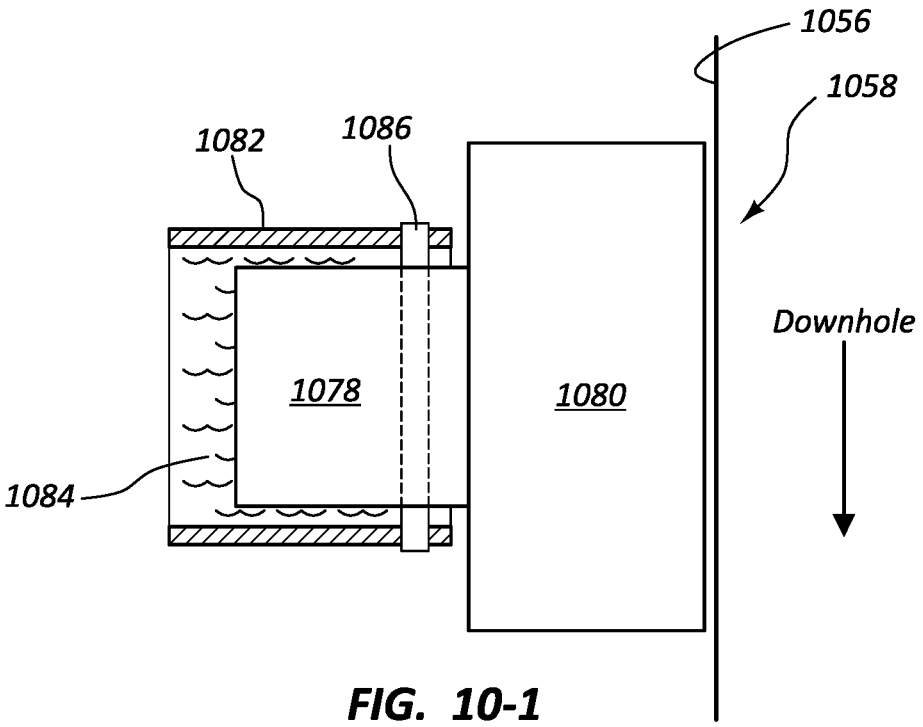
Figures 2, 10:
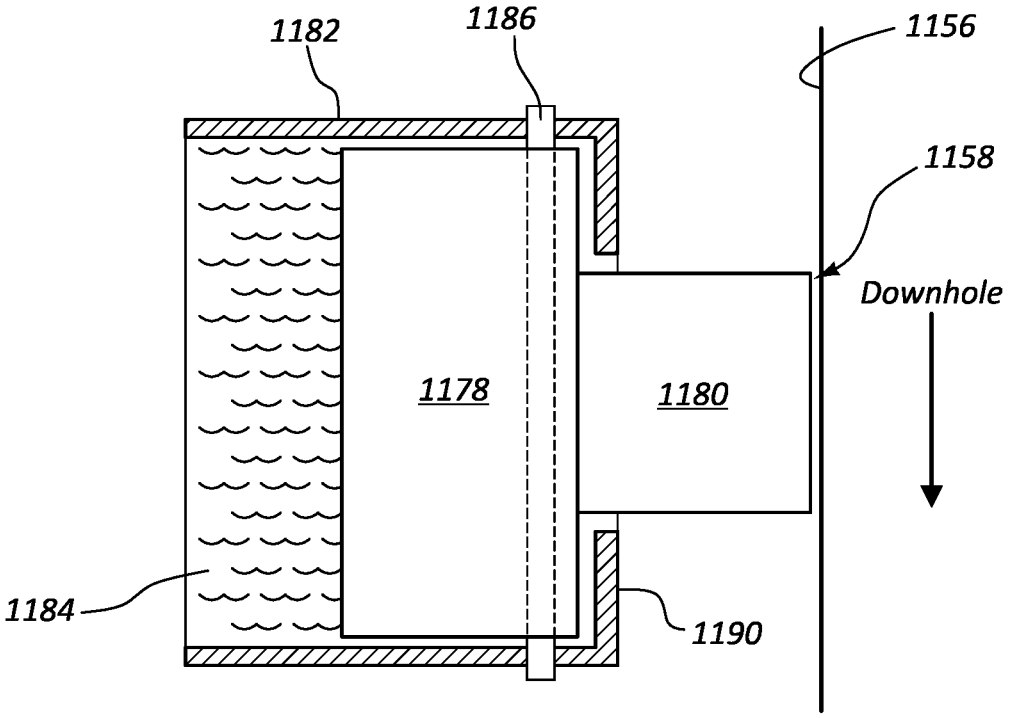

FIGS. 10-1 and 10-2 show an embodiment of the disclosure in which the actuator includes a shaft 1078 and actuator body 1080, the actuator body 1080 including working face 1058 and located radially outward of the shaft 1078. The shaft 1078 may be inserted into a receiver 1082. The receiver 1082 may have a complimentary transverse cross-sectional shape to at least a portion of the actuator 1050 (e.g., the actuator shaft 1078 and/or actuator body 1080). The actuator may be extended and/or retracted through the application of a hydraulic, pneumatic or mechanical force on the end of the shaft 1078. An oil based, water based or drilling mud based hydraulic fluid 1084 may apply the force to shaft 1078, causing shaft 1078 to move relative to a band 1086 and extend from the receiver 1082 toward the wellbore wall 1056. In some embodiments, the band 1086 may provide a fluid seal (as will be described in more detail in relation to FIG. 11-1 through FIG. 12-2). In some embodiments, the shaft 1078 and the actuator body 1080 may have the same transverse cross-sectional shape. In other embodiments, the shaft 1078 and/or the actuator body 1080 may have different transverse cross-sectional shapes. For example, each transverse cross-sectional shape may be circular, any of the profiles envisioned in FIGS. 9-1 through 9-5, or any other transverse cross-sectional shape. In other examples, the shaft 1078 may have a circular transverse cross-sectional shape and the actuator body 1080 may have a square transverse cross-sectional shape. In yet other examples, the shaft 1078 may have a square transverse cross-sectional shape and the actuator body 1080 may have a circular transverse cross-sectional shape.

The shaft 1078 and actuator body 1080 may be integral (e.g., originate from one cohesive block), from which the differences between shaft 1078 and actuator body 1080 are carved, machined, cast in, or otherwise altered. In other embodiments, the shaft 1078 and actuator body 1080 may comprise two separate pieces, the shaft 1078 and actuator body 1080 connected via epoxy, braze, weld, mechanical connection, or the like.

In the embodiment shown in FIG. 10-1, shaft 1078 may have a smaller cross-sectional area than the actuator body 1080. In another embodiment shown in FIG. 10-2, shaft 1178 may have a larger cross sectional area than the actuator body 1180. If the shaft 1178 has a larger cross sectional area than the actuator body 1180, the receiver 1182 may include a stop 1190. During actuation, if the borehole wall 1156 does not prevent further actuation through contact with the working face 1158, then actuation will be stopped by contact of the shaft 1178 with the stop 1190. In at least one embodiment, a shaft 1178 and actuator body 1180 as shown in FIG. 10-2 may amplify the force on the wellbore wall 1156 applied by the hydraulic fluid 1184 to move the shaft 1178 and actuator body 1180 relative to the receiver 1182 and the band 1186.

Figures 1, 11:
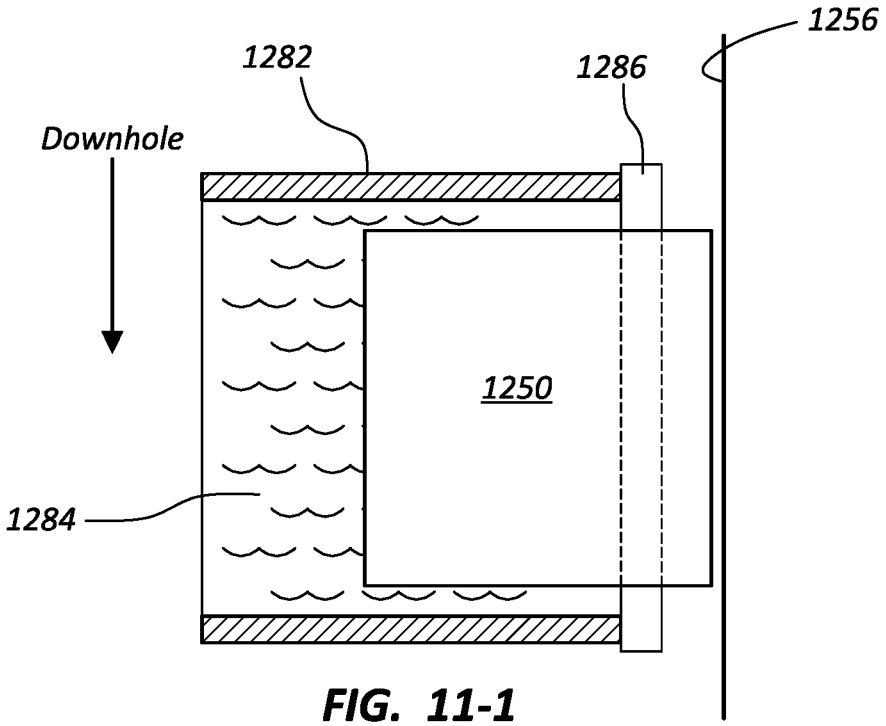
Figures 2, 11:
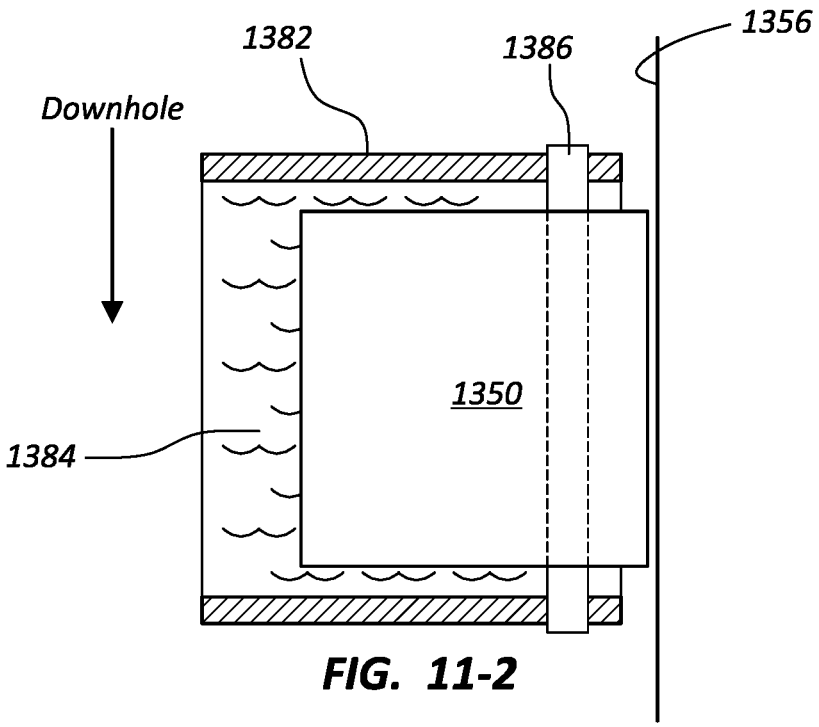

FIG. 11-1 shows still another embodiment of the disclosure, in which actuator 1250 is inserted into receiver 1282. The hydraulic fluid 1284 applies a force to the actuator 1250 to move the actuator 1250 toward the wellbore wall 1256. A band 1286 is positioned at least partially radially between the actuator 1250 and the receiver 1282. For example, the actuator 1250 is positioned radially within the receiver 1282 and at least partially longitudinal within the receiver 1282. There may be some amount of space between the actuator 1250 and the receiver 1282, and the band 1286 may be at least partially located in that radial space. In some embodiments, the band 1286 fully encloses the perimeter of the actuator 1250 along a portion of its length. In the embodiment depicted in the FIG. 11-1, the band 1286 is fixed on the outside of receiver 1282, fully enclosing the perimeter of the actuator 1250.

FIG. 11-2 shows another embodiment in which the band 1386 is located in a groove within the actuator 1350 to retain a hydraulic fluid 1384. An additional embodiment includes the band 1386 located on a groove within the receiver 1386. In this embodiment, the band 1386 be may remain longitudinally static relative to the receiver 1382 as the actuator 1350 moves toward the wellbore wall 1356 but freely rotate about the actuator 1350. In other embodiments, the band 1386 may be fixed longitudinally relative to the actuator 1350 and may move relative to the receiver 1382.

In some embodiments, the band may be a non-elastomeric band 1386. For example, the band 1386 may include or be made of an ultrahard material. In other examples, the band 1386 may include or be made of a metal alloy. In at least one embodiment, the band 1386 may include or be made of a carbide, such as tungsten carbide, silicon carbide, aluminum carbide, boron carbide, or other carbide compounds.

Figures 1, 12:
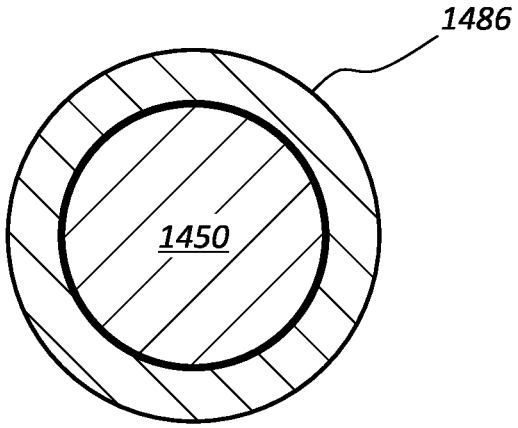
Figures 2, 12:
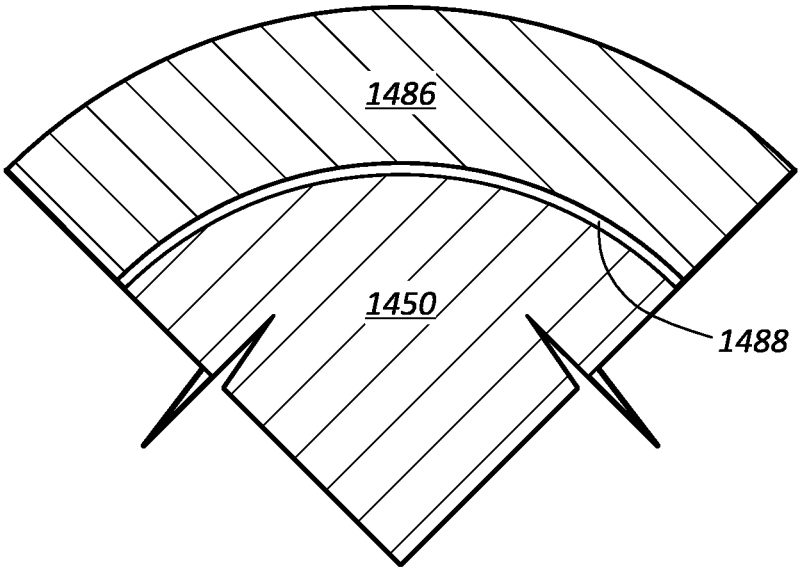

FIG. 12-1 shows a cross-sectional view of the band receiving the actuator. FIG. 12-2 shows a detailed portion of the contact between the band 1486 and the actuator 1450. The band 1486 has a clearance 1488 over the actuator 1450. In some embodiments, the clearance 1488 is sized such that when the hydraulic fluid has a sufficient viscosity, cohesion, adhesion, or combinations thereof, the band 1486 and hydraulic fluid 1484 create a sealing surface around the actuator 1450. For example, the clearance 1488 may be in a range having an upper value, a lower value, or an upper value and lower value including any of 20 microns, 30 microns, 40 microns, 50 microns, 60 microns, 70 microns, 80 microns, 90 microns, 100 microns, or any values therebetween. For example, the clearance 1488 may be greater than 20 microns. In other examples, the clearance 1488 may be less than 100 microns. In yet other examples, the clearance 1488 may be in a range of 20 microns to 100 microns. In further examples, the clearance 1488 may be in a range of 30 microns to 60 microns. The clearance 1488, in combination with the viscosity, cohesion, adhesion, or combinations thereof of the hydraulic fluid 1484 may create a sealing surface around the actuator 1450 to limit and/or prevent the flow of hydraulic fluid 1484 past the band 1486 at working temperatures. While these clearances have been described with reference to the band, these clearances may be used with respect any surface the actuator interfaces with. For example, if no band is used, and the actuator interfaces with the receiver, the clearance between the actuator and receiver, at least at the outermost point of the receiver may be in a range having an upper value, a lower value, or an upper value and lower value including any of 20 microns, 30 microns, 40 microns, 50 microns, 60 microns, 70 microns, 80 microns, 90 microns, 100 microns, or any values therebetween.

Typically, hydraulic fluid 1484 is oil-based to create a sealing surface, although a water-based or drilling-mud based fluid may be used. Standard elastomeric seals may be less durable than a non-elastomeric band sized to create a sealing surface, as the elastomeric seals may break down in the high-repetition environment to which the actuator 1450 is subjected.

Figures 1, 13:
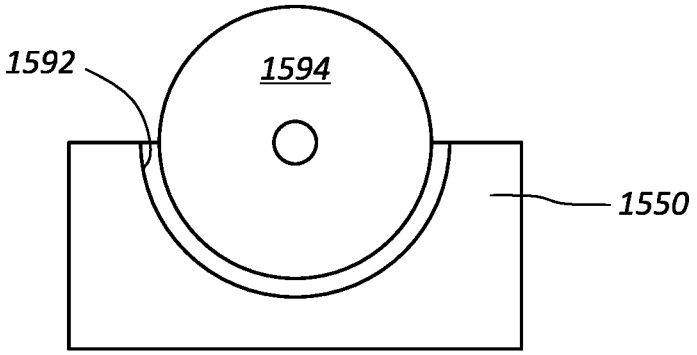
Figures 2, 13:
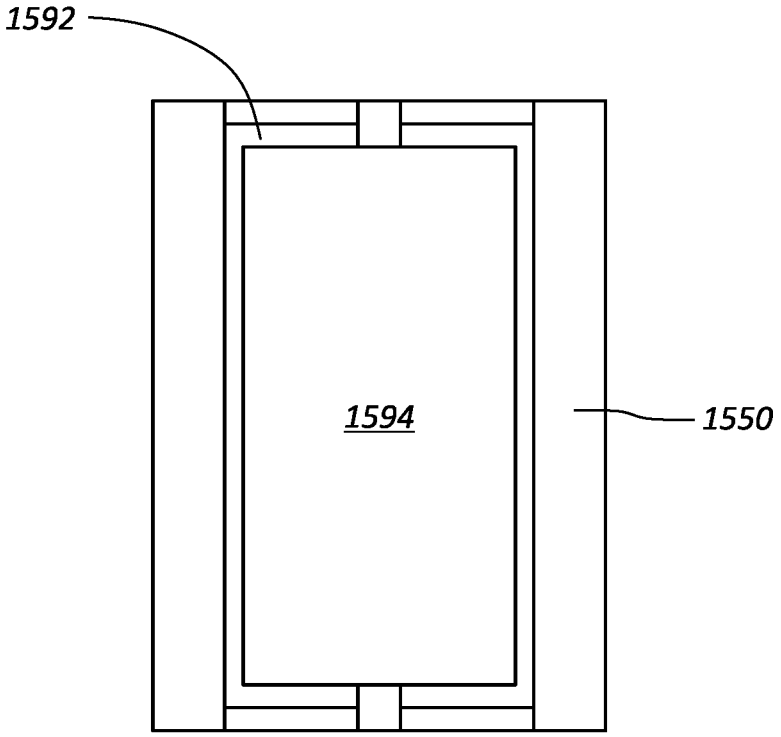

In another embodiment of the disclosure illustrated by FIGS. 13-1 and 13-2, actuator 1550 may include a cradle 1592 facing radially outward. Nestled within the cradle is roller 1594, designed to freely rotate in an axis approximately parallel to the local axis of an RSS tool. When the actuator 1550 is extended far enough that roller 1594 contacts borehole wall, roller 1594 will roll along the borehole wall 1556 until actuator 1550 is retracted or pressure is no longer applied to the backside of the actuator.

A rolling contact with borehole wall 1556 may reduce rotational friction on the steering mechanism, as well as reduce the gouging of borehole wall from a sliding working surface. A variety of materials may be used for the roller 1594, including hard materials such as steel or tungsten carbide (WC), as well as elastomeric materials. In some embodiments, the roller may be made from an elastomeric material, which may result in deformation of the roller 1594 upon contact with the borehole wall 1556. Deformation of the roller 1594 upon contact with the borehole wall 1556 increases the contact surface, which may reduce the pressure on the borehole wall 1556.

In some embodiments, the roller 1594 may include a taper on the downhole end, the taper being a percentage of the total axial length of the roller 1594. In some embodiments, the taper may comprise a range of percentages of the total axial length of the roller 1594, the range having an upper value, a lower value, or upper and lower values including any of 10%, 20%, 30%, 40%, 50%, 60%, 70%, 80%, 90%, 100%, or any value therebetween. For example, the taper may be 10% of the axial length of the roller 1594. In other examples, the taper may be 100% of the axial length of the roller 1594. In yet other examples, the taper may be a range of 10% to 100% of axial length of the roller 1594. In some embodiments, the taper includes 100% of the axial length of the roller 1594, effectively creating a cone out of the roller 1594. The connection between the roller 1594 and the actuator 1550 may pivot on the uphole and/or downhole end of the actuator 1550. The pivotable connection between the actuator 1550 and the roller 1594 may allow the roller 1594 to conform to various contact angles of borehole wall 1556 relative to the actuator 1550.

In some embodiments, an actuator assembly includes a body, a receiver in the body, and an actuator positioned at least partially in the receiver, mounted transverse to a rotational axis of the body. The actuator may have an actuator body and an actuator shaft, the actuator shaft being connected to the actuator body, the actuator body being located radially outward from the actuator shaft, and at least part of the actuator may have a non-circular transverse cross sectional shape. The non-circular transverse cross sectional shape may be elliptical, square, hexagonal, polygonal, or non-polygonal. The actuator shaft may have a transverse cross sectional shape that is different from a transverse cross sectional shape of the actuator body. The receiver may have a complimentary transverse cross-sectional shape to receive the at least part of the actuator. The receiver may limit rotation of the actuator through contact of the receiver with the actuator. The actuator shaft may have a larger cross sectional area than the actuator body. The receiver may have a stop, complementarily shaped with the actuator body, and the stop may be configured to stop extension of the actuator through contact with at least a portion of the actuator shaft that extends beyond a transverse cross sectional shape of the actuator body.

In some embodiments, an actuator assembly may include a body, a receiver in the body, and an actuator positioned at least partially in the receiver, mounted transverse to a rotational axis of the body. The assembly may include a non-elastomeric band, and the non-elastomeric band may be positioned in the receiver such that at least part of the non-elastomeric band is positioned between the actuator and the receiver. The non-elastomeric band may include tungsten carbide. The assembly may further include a fluid positioned in the receiver and in contact with a portion of the actuator positioned at least partially in the receiver. The fluid may be positioned between at least a portion of the non-elastomeric band and at least one of the receiver and the actuator. The non-elastomeric band may be at least partially fixed relative to the receiver. The assembly may further include a clearance between the non-elastomeric band and at least one of the actuator and the receiver. The non-elastomeric band may be at least partially located in a groove.

In some embodiments, an assembly for steering a rotary tool relative to a borehole wall includes a body having a rotational axis, and a plurality of actuators, at least one of the plurality of actuators positioned at least partially in the body and configured to move transverse to the rotational axis of the body. At least one actuator may have a cradle, and a roller at least partially within the cradle and configured to rotate relative to the cradle, the roller positioned radially outward from the body relative to the cradle and having a downhole end. The roller may include an elastomeric material to increase the contact area with the borehole wall. A downhole edge of roller may be tapered between 10% and 100% of an axial length of the roller. The roller may be pivotally mounted to the cradle at an uphole end of the roller. The roller may be pivotally mounted to the cradle at the downhole end of the roller. The roller may include tungsten carbide.

Although the embodiments of drilling systems and associated methods have been primarily described with reference to wellbore drilling operations, the drilling systems and associated methods described herein may be used in applications other than the drilling of a wellbore. In other embodiments, drilling systems and associated methods according to the present disclosure may be used outside a wellbore or other downhole environment used for the exploration or production of natural resources. For instance, drilling systems and associated methods of the present disclosure may be used in a borehole used for placement of utility lines, or in a bit used for a machining or manufacturing process. Accordingly, the terms "wellbore," "borehole" and the like should not be interpreted to limit tools, systems, assemblies, or methods of the present disclosure to any particular industry, field, or environment.

References to "one embodiment" or "an embodiment" of the present disclosure are not intended to be interpreted as excluding the existence of additional embodiments that also incorporate the recited features. For example, any element described in relation to an embodiment herein is combinable with any element of any other embodiment described herein, unless such features are described as, or by their nature are, mutually exclusive. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value. Where ranges are described in combination with a set of potential lower or upper values, each value may be used in an open-ended range (e.g., at least 50%, up to 50%), as a single value, or two values may be combined to define a range (e.g., between 50% and 75%).

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. Changes that come within the meaning and range of equivalency of the claims are to be embraced within their scope.

What is claimed is:

1. A downhole tool, comprising:

a tool body; and an actuator coupled to and selectively extendible relative to the tool body, the actuator including a working face arranged and designed to contact a downhole formation, the working face including:

a first material and a second material, wherein the second material includes an ultrahard material having a different coefficient of friction than the first material, and wherein the working face is configured such that the first and second materials contact the downhole formation;

an upper portion including the first material; and a lower portion including a tapered surface that is directed radially inwardly and axially downwardly relative to the axis of rotation of the tool body, wherein at least a portion of the tapered surface includes the second material.

2. The downhole tool of claim 1, the second material being located on one or more of a perimeter or leading edge of the lower portion.

3. The downhole tool of claim 1, wherein the second material is part of an ultrahard insert coupled to the first material.

4. The downhole tool of claim 1, wherein the second material is on at least 25% of the working face.

5. The downhole tool of claim 1, wherein the second material is on at least 50% of the tapered surface and at least a portion of the upper portion.

6. The downhole tool of claim 1, wherein the second material includes polycrystalline diamond.

7. The downhole tool of claim 1, wherein the second material is on at least a portion of a downhole edge of the lower portion.

8. The downhole tool of claim 1, wherein the tapered surface makes up a full surface of the lower portion.

9. The downhole tool of claim 8, wherein the lower surface includes the first material and the second material.

10. The downhole tool of claim 8, wherein the upper surface includes the first material and the second material.

11. The downhole tool of claim 10, wherein the second material makes up a greater portion of the lower surface than of the upper surface.

12. The downhole tool of claim 1, wherein a surface area of the lower portion is greater than a surface area of the upper portion.

13. The downhole tool of claim 1, wherein a ratio of a coefficient of friction of the first material to a coefficient of friction of the second material is between 3:1 and 5:1.

14. The downhole tool of claim 1, wherein the tool body is a rotary steerable drilling tool body and the actuator is a steering pad.

15. The downhole tool of claim 14, further comprising a plurality of the actuators, wherein the plurality of actuators are steering pads that are offset at angular intervals around the tool body and are separately extendible.

16. A downhole tool, comprising:

a tool body; and an actuator coupled to and selectively extendible relative to the tool body, the actuator including a working face arranged and designed to contact a downhole formation, the working face including:

a first surface approximately parallel to the axis of rotation of the tool body, wherein the first surface makes up less than 50% of the surface area of the working face;

a second surface, wherein the second surface is tapered radially inwardly and axially downwardly relative to the axis of rotation of the tool body;

an axial length of the second surface is greater than 50% and less than 90% of an axial length of the working face; and the axial length of the second surface and of the working face is the component of the length of the second surface and of the working face that is in the direction parallel to the axis of rotation of the tool body.

17. The downhole tool of claim 16, the first surface including a first material and the second surface including a second material, the first and second materials having different coefficients of friction.

18. The downhole tool of claim 17, the first surface and the second surface each including the first material and the second material.

19. The downhole tool of claim 17, wherein at least a portion of a leading edge or downhole edge of the second surface is formed by an ultrahard material.

20. The downhole tool of claim 16, the second surface being located downhole of the first surface and working face further including a third surface uphole of the first surface such that the first surface is adjacent the second and third surfaces, the third surface being tapered radially inwardly and axially upwardly relative to the axis of rotation of the tool body.

* * * * *